US006621668B1

(12) United States Patent
Sare

(10) Patent No.: US 6,621,668 B1
(45) Date of Patent: Sep. 16, 2003

(54) RELAY CIRCUIT MEANS FOR CONTROLLING THE APPLICATION OF AC POWER TO A LOAD USING A RELAY WITH ARC SUPPRESSION CIRCUITRY

(75) Inventor: Jorge Sare, Lawrenceville, NJ (US)

(73) Assignee: Zytron Control Products, Inc., Trenton, NJ (US)

( * ) Notice: Subject to any disclaimer, the term of this patent is extended or adjusted under 35 U.S.C. 154(b) by 252 days.

(21) Appl. No.: 09/603,679

(22) Filed: Jun. 26, 2000

(51) Int. Cl.[7] ..... H01H 9/30
(52) U.S. Cl. ..... 361/13
(58) Field of Search ..... 361/2, 3, 4, 8, 361/13, 159

(56) References Cited

U.S. PATENT DOCUMENTS

| | | | | |
|---|---|---|---|---|
| 2,637,769 A | | 5/1953 | Walker | |
| 3,372,303 A | | 3/1968 | Knott | |
| 3,555,353 A | | 1/1971 | Casson | |
| 3,558,910 A | | 1/1971 | Dale et al. | |
| 3,639,808 A | | 2/1972 | Ritzow | |
| 3,783,305 A | | 1/1974 | Lefferts | |
| 3,982,137 A | | 9/1976 | Penrod | |
| 4,025,820 A | | 5/1977 | Penrod | |
| 4,152,634 A | | 5/1979 | Penrod | |
| 4,251,845 A | | 2/1981 | Hancock | |
| 4,296,449 A | | 10/1981 | Eichelberger | |
| 4,360,847 A | | 11/1982 | Bloomer et al. | |
| 4,389,691 A | | 6/1983 | Hancock | |
| 4,438,472 A | | 3/1984 | Woodworth | |
| 4,525,762 A | | 6/1985 | Norris | |
| 4,700,256 A | | 10/1987 | Howell | |
| 4,745,511 A | | 5/1988 | Kugelman et al. | |
| 4,754,360 A | | 6/1988 | Nakada | |
| 4,760,483 A | | 7/1988 | Kugelman et al. | |
| 4,772,809 A | | 9/1988 | Koga et al. | |
| 4,816,818 A | | 3/1989 | Roller | |
| 4,855,612 A | | 8/1989 | Koga et al. | |
| 4,959,746 A | | 9/1990 | Hongel | |
| 5,081,558 A | | 1/1992 | Mahler | |
| 5,151,840 A | * | 9/1992 | Siefken | 361/13 |
| 5,247,418 A | | 9/1993 | Auge | |
| 5,283,706 A | * | 2/1994 | Lillemo et al. | 361/3 |
| 5,406,442 A | * | 4/1995 | Kristensen | 361/187 |
| 5,449,988 A | * | 9/1995 | Gurstein et al. | 318/430 |
| 5,536,980 A | | 7/1996 | Kawate et al. | |
| 6,046,899 A | * | 4/2000 | Dougherty | 361/173 |

* cited by examiner

*Primary Examiner*—Ronald W. Leja
(74) *Attorney, Agent, or Firm*—Sperry, Zoda & Kane

(57) ABSTRACT

A solid state arc suppression circuitry is defined for placement in parallel extending over the mechanical contacts of a conventional coil and contact mechanical relay mechanism for the purpose of eliminating arcing between the relay contacts which usually occurs immediately prior to closing thereof or immediately after opening thereof. This arc suppression circuitry includes a first circuitry section positioned in parallel with respect to the coil energizing circuit which is activated simultaneously with activating the coil and which is operable through an optical coupling device to activate a second solid state circuit which is positioned extending in parallel with respect to the relay contact to eliminate the transient arching currents thereover during opening and closing of the contacts. The sensing circuit preferably includes a light emitting diode photocoupled to an optotriac for linking operation of the first and second solid state circuits with respect to one another. A solid state switch such as a triac is included in the second circuit apparatus for arc suppression as the relay contacts are moved toward or away from one another. The first solid state circuit also includes a primary capacitor in parallel with the electromagnetic coupling means to provide a short term surge of power therethrough simultaneously with de-powering of the relay coil to activate the second solid state arc suppression switching circuit to eliminate arching across the relay contact as they are opened.

17 Claims, 6 Drawing Sheets

RELAY CIRCUIT MEANS FOR CONTROLLING THE APPLICATION OF AC POWER TO A LOAD USING A RELAY WITH ARC SUPPRESSION CIRCUITRY

BACKGROUND OF THE INVENTION

1. Field of the Invention

The present invention deals with the field of electrical devices generally known as relays as well as the control circuit operative therewith. Such relay devices normally include a coil with relay contacts which are operable to close and open responsive to powering and de-powering, respectively, of the coil. This is an electro-mechanical operation which normally occurs in a matter of milliseconds. However, immediately after opening of the mechanical contacts, transient arcing currents can occur which tend to damage the surfaces of the mechanical contact by burning or allowing material to migrate from one contact to the other. Some minor arcing may also occur immediately after closing of the mechanical contacts if they bounce or wipe with respect to one another. Devices have been designed for the purposes of minimizing these transient arcing currents, however, the present invention provides a very rapidly responsive transient current suppressing system which preferably makes use of optical coupling and can be utilized with AC or DC relay coils.

2. Description of the Prior Art

Numerous prior art patents have been found for the purposes of relay control and the suppression of arcing in cross relay contacts such as shown in U.S. Pat. No. 2,637,769 patented May 5, 1953 to A. H. B. Walker and assigned to Westinghouse Brake and Signal Company Limited on a "Means For Suppressing Arcing at Contacts Breaking A Direct Current Inductive Circuit"; and U.S. Pat. No. 3,372,303 patented Mar. 5, 1968 to L. G. W. Knott and assigned to F. Devetta (Electronics) Limited on "A. C. Switch Contacts"; and U.S. Pat. No. 3,555,353 patented Jan. 12, 1971 to Charles F. Casson and assigned to American Machine & Foundry Company on a "Means Effecting Relay Contact Arc Suppression In Relay Controlled Alternating Load Circuits"; and U.S. Pat. No. 3,558,910 patented Jan. 26, 1971 to Robert G. Dale et al and assigned to Motorola, Inc. on "Relay Circuits Employing A Triac To Prevent Arcing"; and U.S. Pat. No. 3,639,808 patented Feb. 1, 1972 to Gerald R. Ritzow and assigned to Cutler-Hammer, Inc. on "Relay Contact Protecting Circuits"; and U.S. Pat. No. 3,783,305 patented Jan. 1, 1974 to Peter Lefferts and assigned to Heinemann Electric Company on an "Arc Elimination Circuit"; and U.S. Pat. No. 3,982,137 patented Sep. 21, 1976 to John K. Penrod and assigned to Power Management Corporation on an "Arc Suppressor Circuit"; and U.S. Pat. No. 4,025,820 patented May 24, 1977 to John K. Penrod and assigned to Power Management Corporation on a "Contactor Device Including Arc Suppression Means"; and U.S. Pat. No. 4,152,634 patented May 1, 1979 to John K. Penrod and assigned to Power Management Corporation on a "Power Contactor And Control Circuit; and U.S. Pat. No. 4,251,845 patented Feb. 17, 1981 to Harold E. Hancock and assigned to Power Management Corporation on an "Arc Suppressor Circuit"; and U.S. Pat. No. 4,296,449 patented Oct. 20, 1981 to Charles W. Eidhelberger and assigned to General Electric Company on a "Relay Switching Apparatus"; and U.S. Pat. No. 4,360,847 patented Nov. 23, 1982 to Milton D. Bloomer et al and assigned to General Electric Company on a "Diode Assisted Relay Contactor"; and U.S. Pat. No. 4,389,691 patented Jun. 21, 1983 to Harold E. Hancock and assigned to Power Management Corporation on a "Solid State Arc Suppression Device"; and U.S. Pat. No. 4,438,472 patented Mar. 20, 1984 to George K. Woodworth and assigned to IBM Corporation on an "Active Arc Suppression For Switching Ofg Direct Current Circuits"; and U.S. Pat. No. 4,525,762 patented Jun. 25, 1985 to Claude R. Norris on an "Arc Suppression Device and Method"; and U.S. Pat. No. 4,700,256 patented Oct. 13, 1987 to Edward K. Howell and assigned to General Electric Company on a "Solid State Current Limiting Circuit Interrupter"; and U.S. Pat. No. 4,745,511 patented May 17, 1988 to Michael M. Kugelman et al and assigned to The BF Goodrich Company on a "Means For Arc Suppression In Relay Contacts"; and U.S. Pat. No. 4,754,360 patented Jun. 28, 1988 to Ryosaku Nakada and assigned to Nipponkouatsudenki Kabushikikaisha on an "Arc Extinguishing Apparatus Having Sensing of Initial Arc"; and U.S. Pat. No. 4,760,483 patented Jul. 26, 1988 to Michael M. Kugelman et al and assigned to The B.F. Goodrich Company on a "Method For Arc Suppression In Relay Contacts"; and U.S. Pat. No. 4,772,809 patented Sep. 20, 1988 to Hirofumi Koga et al and assigned to Omron Tateisi Electronics Co. on a "Switching Circuit And A Relay Device Employed To Prevent Arcing"; and U.S. Pat. No. 4,816,818 patented Mar. 28, 1989 to Philip C. Roller and assigned to Truck-Lite Co., Inc. on a "Heavy Duty Lamp Flasher For Trucks, Trailers And The Like"; and U.S. Pat. No. 4,855,612 patented Aug. 8, 1989 to Hirofumi Koga et al and assigned to Omron Tateisi Electronics Co. on a "Switching Current And A Relay Device Employed Therein"; and U.S. Pat. No. 4,959,746 patented Sep. 25, 1990 to Chester C. Hongel and assigned to Electronic Specialty Corporation on a "Relay Contact Protective Circuit"; and U.S. Pat. No. 5,081,558 patented Jan. 14, 1992 to Leo M. Mahler and assigned to Northrop Corporation on "High Voltage DC Relays"; and U.S. Pat. No. 5,247,418 patented Sep. 21, 1993 to George C. Auge on an "Arc Suppressing Switch"; and U.S. Pat. No. 5,536,980 patented Jul. 16, 1996 to Keith W. Kawate et al and assigned to Texas Instruments Incorporated on a "High Voltage, High Current Switching Apparatus".

SUMMARY OF THE INVENTION

The present invention takes advantage of the useful characteristics of a mechanical relay in combination with the advantages of a solid state relay by combining operation therebetween. In particular, the mechanical relay has contacts which can carry higher currents for longer periods of time without deterioration and without any need for dissipating heat. This characteristic is apparent in mechanical contacts since the current flowing therethrough generates a negligible amount of heat because of the very low voltage drop across these contacts when fully closed. The disadvantage, however, of mechanical contacts within the mechanical relay is that damaging arcing often occurs, immediately after opening, because at these times the contacts are very close to one another and arcing can easily occur. This arcing causes appreciable erosion of the contacts and deteriorates the contact surfaces and undesirably increases the voltage drop across such contacts, and can ultimately lead to contact failure. The deterioration of the mechanical contact surfaces can be attributable to the migration of material which can occur during the arcing, as well as the burning or charring of the contact surfaces.

A solid state switching mechanism has strikingly different operating characteristic advantages and disadvantages. In particular, a solid state switch such as a thyristor or transistor can open or close electrical circuits without any arcing whatsoever because of the nature of the solid state design. The problem with these devices however is they are severely stressed or can be permanently damaged by heat which builds up quickly when required to carry high currents. This unwanted heat is the result of the high voltage drop across these devices during operation thereof. Thus, very large and somewhat expensive heat sinks or other heat dissipation devices must be used in order to remove the heat when such solid state switches are required to carry fairly large currents for long periods of time.

The present invention takes advantage of the distinctively different characteristics of the mechanical relay and the solid state switch by using circuitry that connects the solid state switch in parallel to the relay contact. In the configuration of the present invention the solid state switch is operative to begin conducting, that is, becomes turned on just before the relay contacts close and become non-conductive a short time after the relay contacts have opened and remain non-conductive outside of these time periods. However, once the mechanical contacts are closed, since the voltage drop across the mechanical contacts is much lower than the voltage drop across the solid state switch, almost all current will flow through the mechanical switch thereby having virtually no current flow through the solid state-switch even though the switch is technically "on". This is because the solid state switch has such a higher voltage drop there across which almost eliminates current flow therethrough and thus the switch acts as if it were not capable of operating.

To achieve this configuration the present invention preferably includes a relay which includes relay contacts which are movable between an open position preventing current flow therethrough and a closed position allowing current flow therethrough. A relay coil is included also which is electromagnetically operatively connected to the relay contacts and is operative to urge the relay contacts to the closed position responsive to powering of the relay coil and is operative to allow movement of the relay contacts to the open position responsive to de-powering of the relay coil. A relay coil powering circuit is also included electrically in series with the relay coil for selectively powering and de-powering thereof. This relay coil powering circuit can be AC powered or DC powered.

An arc suppression circuit is included as a critical aspect of the present invention which senses the powering and de-powering of the relay coil. This arc suppression circuit is designed for suppressing transient electrical arcing across the relay contacts during closing and opening thereof. The arc suppression circuitry preferably includes a first solid state circuit in electrical communication with the relay coil powering circuit to be activated selectively responsive to powering and de-powering of the relay coil. This first solid state circuit is electrically in parallel with respect to the relay coil. The apparatus further includes a second solid state circuit means which is electrically coupled to the first solid state circuit to sense activation and termination thereof. This coupling is preferably made through an electromagnetic coupling means such as an optocoupler. The second solid state circuit is connected electrically in parallel with respect to the relay contact to prevent arcing therebetween by shunting thereover.

The configuration of the first solid state circuit preferably includes a first diode in series with the electromagnetic coupling means in order to maintain current flow therethrough in only one direction. A current limiting resistor is also included in series with the first diode positioned between the electromagnetic coupling means and the first diode to limit current flow therethrough and control delays. A primary capacitor is also included electrically in parallel with respect to the current limiting resistor. This primary capacitor is adapted to discharge through the current limiting resistor and the optocoupler for a limited period of time responsive to de-powering of the first solid state conduit means in order to activate the second solid state circuit and eliminate transient arcing during opening of the relay contacts.

A discharge resistor is also included preferably in series with the primary capacitor. This discharge resistor is optional. A second diode is also included positioned electrically in parallel with respect to the relay coil and also being electrically in parallel with respect to the first diode and is operatively oriented for current flow therethrough in order to suppress conductive power spiking through the relay coil.

The second solid state circuit means preferably includes a main solid state switching member which includes preferably a main triac positioned electrically in parallel with respect to the relay contacts in order to eliminate transient current arcing across the relay contacts when opening and closing thereof responsive to the main solid state switching device being operative. A switch firing resistor is also included electrically connected to the main solid state switching means to be powered simultaneously therewith.

The electromagnetic coupling means is preferably operative to provide electrical communication from the first solid state circuit to the second solid state circuit to selectively cause powering of the second solid state circuit responsive to activation of the first solid state circuit. The electromagnetic coupling device is preferably optically controlled and is electronically in parallel with respect to the primary capacitor means to facilitate operation thereof for a limited period of time responsive to discharge of the primary capacitor immediately after de-powering of the relay coil. The preferred configuration of the electromagnetic coupling means includes a light emitting diode positioned in series with the first diode and the current limiting resistor of the first solid state circuit to facilitate electromagnetic coupling between the first solid state circuit and the second solid state circuit. Also an optically activated solid state switching device such as an optotriac is located proximate to the light emitting diode and is included electrically in communication with respect to the main solid state switching means and is operative to activate the main solid state switching device responsive to activation of the light emitting diode. Thus, activation of the light emitting diode will turn on the optotriac which will communicate to a main triac located in the second solid state circuit such that conducting through the solid state switching apparatus across the relay contacts will occur.

An AC powering circuit means are also included electrically in communication with an AC load means for selectively supplying AC power thereto responsive to closing of the relay contacts or turning on of the solid state shunting switch.

It is an object of the relay circuit of the present invention to control the application of AC power to a load by suppression of transient arcing across the relay contacts wherein current flow through relay mechanical relay contacts immediately prior to closing and immediately after the initiation of opening is prevented.

It is an object of the relay circuit of the present invention to control the application of AC power to a load by suppression of transient arcing across the relay contacts wherein maintenance costs for refinishing or replacing relays is minimized.

It is an object of the relay circuit of the present invention to control the application of AC power to a load by suppression of transient arcing across the relay contacts wherein down time of mechanical apparatus is minimized.

It is an object of the relay circuit of the present invention to control the application of AC power to a load by suppression of transient arcing across the relay contacts wherein a relatively inexpensive solid state circuit can be used for suppression of transient arcing.

It is an object of the relay circuit of the present invention to control the application of AC power to a load by suppression of transient arcing across the relay contacts wherein the transmitting characteristics of mechanical contacts and solid state switching devices are coordinated to achieve a long lasting and effectively operating relay circuit means.

It is an object of the relay circuit of the present invention to control the application of AC power to a load by suppression of transient arcing across the relay contacts wherein the use of relatively expensive heat sinks and other heat dissipation devices is avoided.

It is an object of the relay circuit of the present invention to control the application of AC power to a load by suppression of transient arcing across the relay contacts wherein the surface condition of mechanical contacts of a relay coil can be maintained for vastly higher numbers of operations.

It is an object of the relay circuit of the present invention to control the application of AC power to a load by suppression of transient arcing across the relay contacts wherein usage is possible with either an AC or DC relay coil.

It is an object of the relay circuit of the present invention to control the application of AC power to a load by suppression of transient arcing across the relay contacts wherein unwanted transient arcing across relay contacts is achieved even during conditions of mechanical contact bounce.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
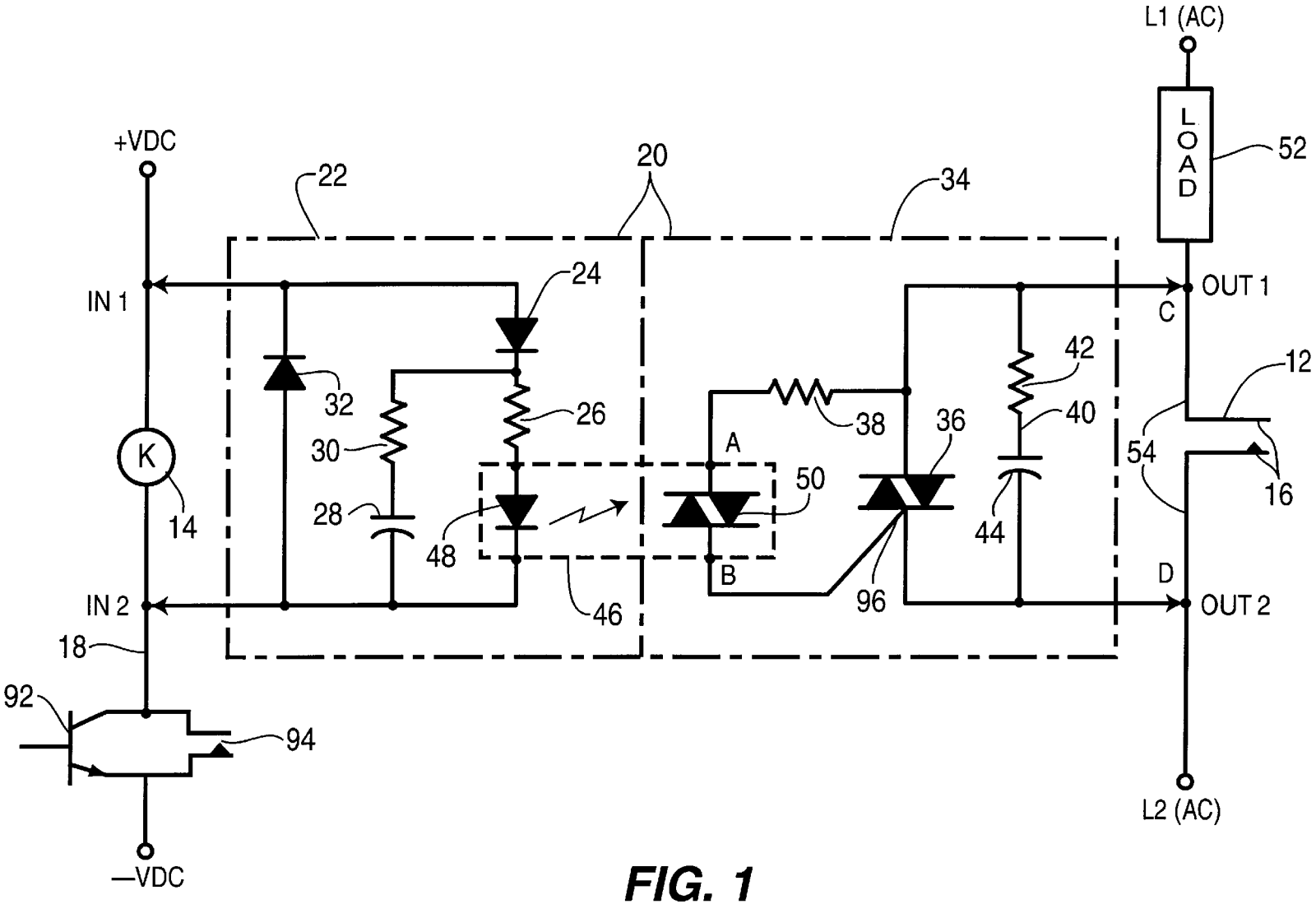
FIG. 1 is an electrical schematic diagram of an embodiment of the relay control circuit of the present invention.

The circuit of the present invention is designed to be used with a relay 12 which comprises a selectively actuated relay coil 14 operative to open and close relay contacts 16. In normal operation relay contacts 16 will be normally open and will close responsive to powering of the relay coil 14. As such, subsequent de-powering of relay coil 14 will allow the relay contacts 16 to assume the steady state open position. The relay coil is powered through a relay coil power circuit 18 which is preferably connected to a DC or in some cases AC powering circuit and which can be turned on by the closing of a solid state switch 92 or mechanical switch 94 or any other power interrupting means for selectively controlling the powering of the relay coil power circuit 18.

The relay contacts 16 will preferably be positioned in an AC powering circuit 54. This AC powering circuit 54 is preferably connected to a source of AC power and is operative to selectively power an AC load means 52 which can be any conventional AC load. With this configuration powering and de-powering of the relay coil power circuit 18 will control powering and de-powering of the relay coil 14 which will cause opening and closing of the relay contacts 16 which will selectively cause powering and de-powering of the AC load 52.

If all of the AC power is directed through the relay contacts 16 at all times, significant arcing would occur between the relay contacts immediately after opening of these contacts due to the close spacing between the contacts during these very limited time periods. However this arcing can significantly damage the contacts by causing the migration of material from one contact to another or by the burning or otherwise deteriorating of the contact surfaces thereby undesirably increasing the voltage resistance across the contacts and ultimately requiring the contacts to be resurfaced or replaced. For this reason the present invention provides a unique arc suppression circuit means 20.

The arc suppression circuit 20 includes a first solid state circuit 22 preferably electrically connected to the relay coil 14 and more preferably in parallel electrically therewith. An electromagnetic coupling means 46 is operative to sense activation of the first solid state circuit means 22 and initiate activation of a second solid state circuit means 34. The second solid state circuit means 34 provides a switching mechanism extending within the AC power circuit 54 across the relay contacts 16 to be parallel therewith. In this manner the second solid state circuit 34 can carry the AC current traveling through the AC powering circuit 54 during opening and closing of the relay contacts 16.

The first solid state circuit 22 preferably includes a first diode 24 electrically in series with respect to a current limiting resistor 26 and a light emitting diode 48 preferably located within the electromagnetic coupling means 46. In this manner activation of the relay coil 14 will cause current to pass through diode 24 through current limiting resistor 26 and urge the coupling means 46 on the side of the first solid state circuit to begin operating with the use of a light emitting diode 48 that will initiate the generation of light by this diode 48.

The first solid state circuit 22 can also include a second diode 32 electrically in parallel to the relay coil 14 and to the diode 24, resistor 26 and light emitting diode 48. This second diode 32 is operative to suppress conductive spikes in the relay coil 14.

The first solid state circuit 22 preferably also includes a primary capacitor 28 and optionally a discharge resistor 30 positioned in parallel to the resistor 26 and the light emitting diode 48. This primary capacitor 28 is operative to discharge immediately after the de-powering of the relay coil 14 to send a surge of current flow for a short period of time through the light emitting diode 48 to initiate coupled operation of the second solid state circuit 34 for a short time period after opening of coil 14 to eliminate arcing between the relay contacts 16 during opening thereof.

The operation of the electromagnetic coupling means 46 is preferably achieved by the inclusion of an optotriac within the coupling means 46 adjacent to the second solid state circuit 34. This optotriac 50 will be turned on by the emitting of light by the light emitting diode 48. The optotriac 50 is electrically connected to the main solid state switching device or main triac 36. When the optotriac 50 is turned on this will cause the main triac 36 to turn on to place it in a state of conducting. This conducting will allow the AC power traveling through the AC powering circuit 54 to go through the main triac 36 rather than through the relay contacts 16. The only time current will flow through the relay contacts 16 is when the contacts are completely closed since during those times the voltage drop across the relay contacts 16 is much less than the voltage drop across the main triac 36.

A triac firing resistor 38 is included in the second solid state circuit 34 preferably in series with the optotriac 50 of the coupling means 46.

The second solid state circuit 34 can include an RC network 40 extending in parallel to the main triac. This RC network can include an network resistor 42 and a network capacitor 44.

Figure 2:
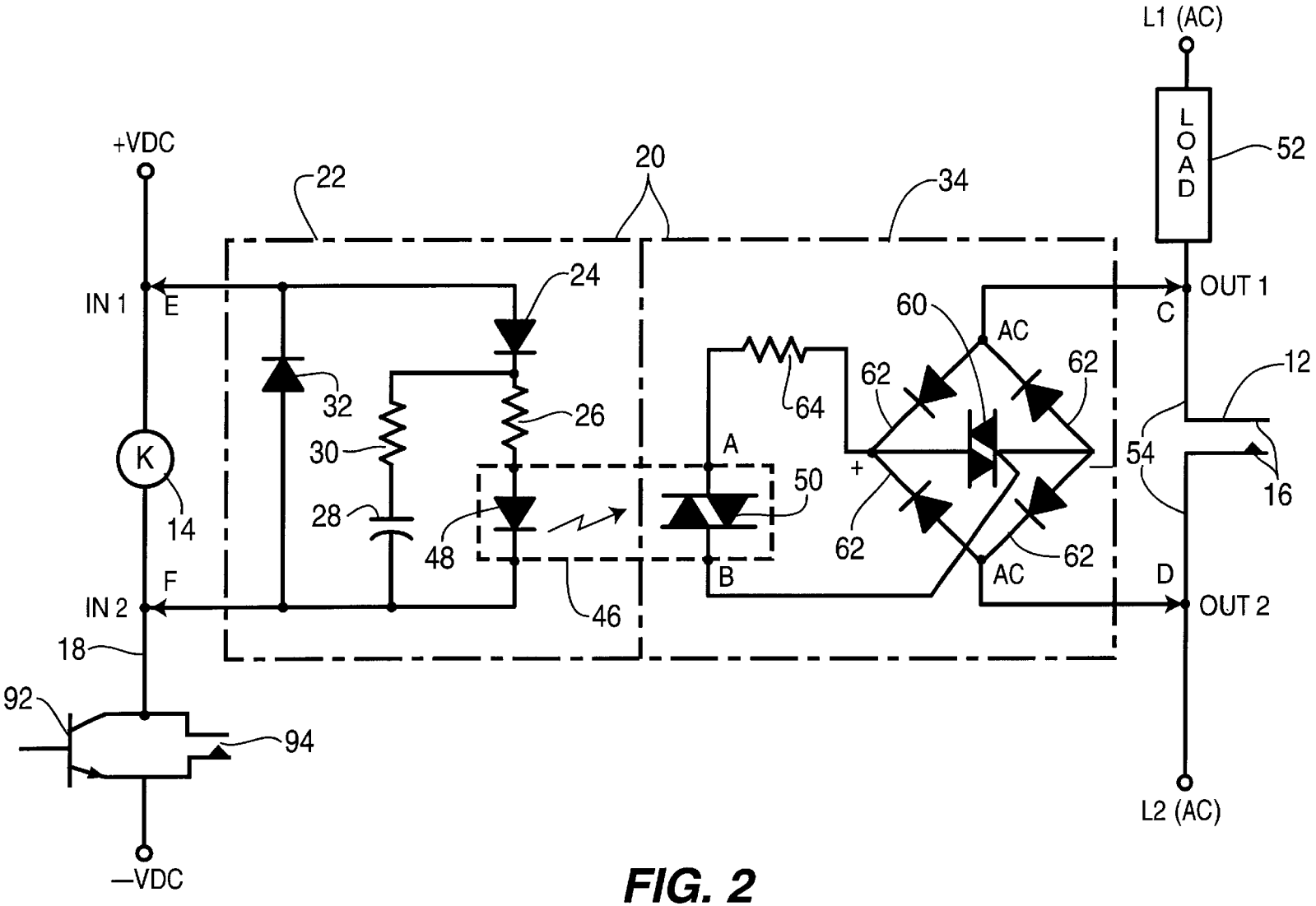
FIG. 2 is an alternative embodiment of the configuration shown in FIG. 1 utilizing an SCR thyristor with a bridge rectifier as operating elements of the second solid state circuit.

FIG. 2 shows an alternative configuration for the second solid state circuit 34 utilizing a main triac 60 positioned within the bridge rectifier 62 along with the use of the firing resistor 64.

Figure 3:
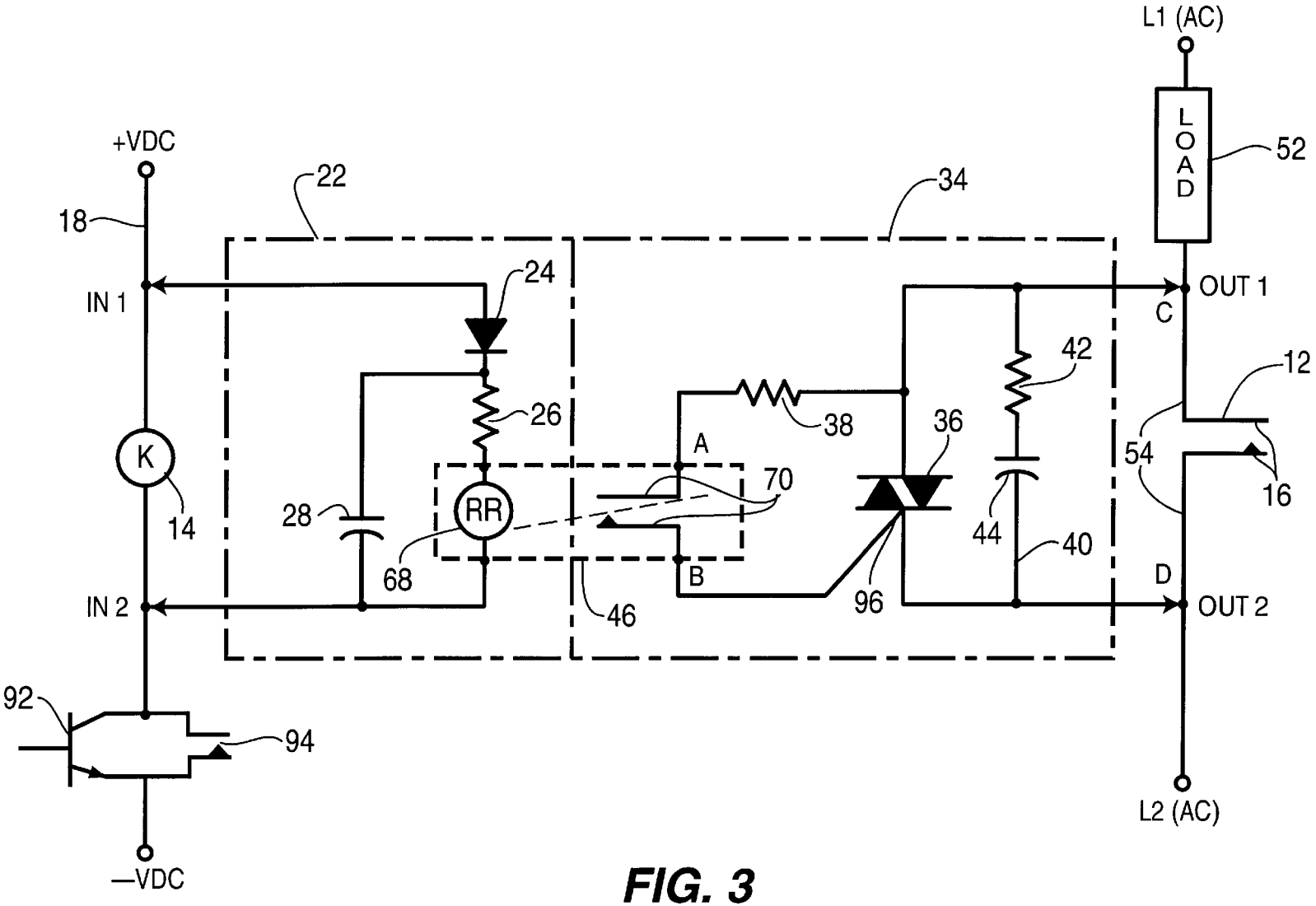
FIG. 3 is an alternative illustration of the embodiment shown in FIG. 1 showing the use of a reed relay as the electromagnetic coupling device in place of the optocoupling device.

FIG. 3 shows an alternative configuration for the optically activated solid state switch 50 or optotriac wherein a reed relay 68 is used in combination with reed relay contacts 70 to provide an equivalent linking between the first solid state circuit 22 and the second solid state circuit 34.

Figure 4:
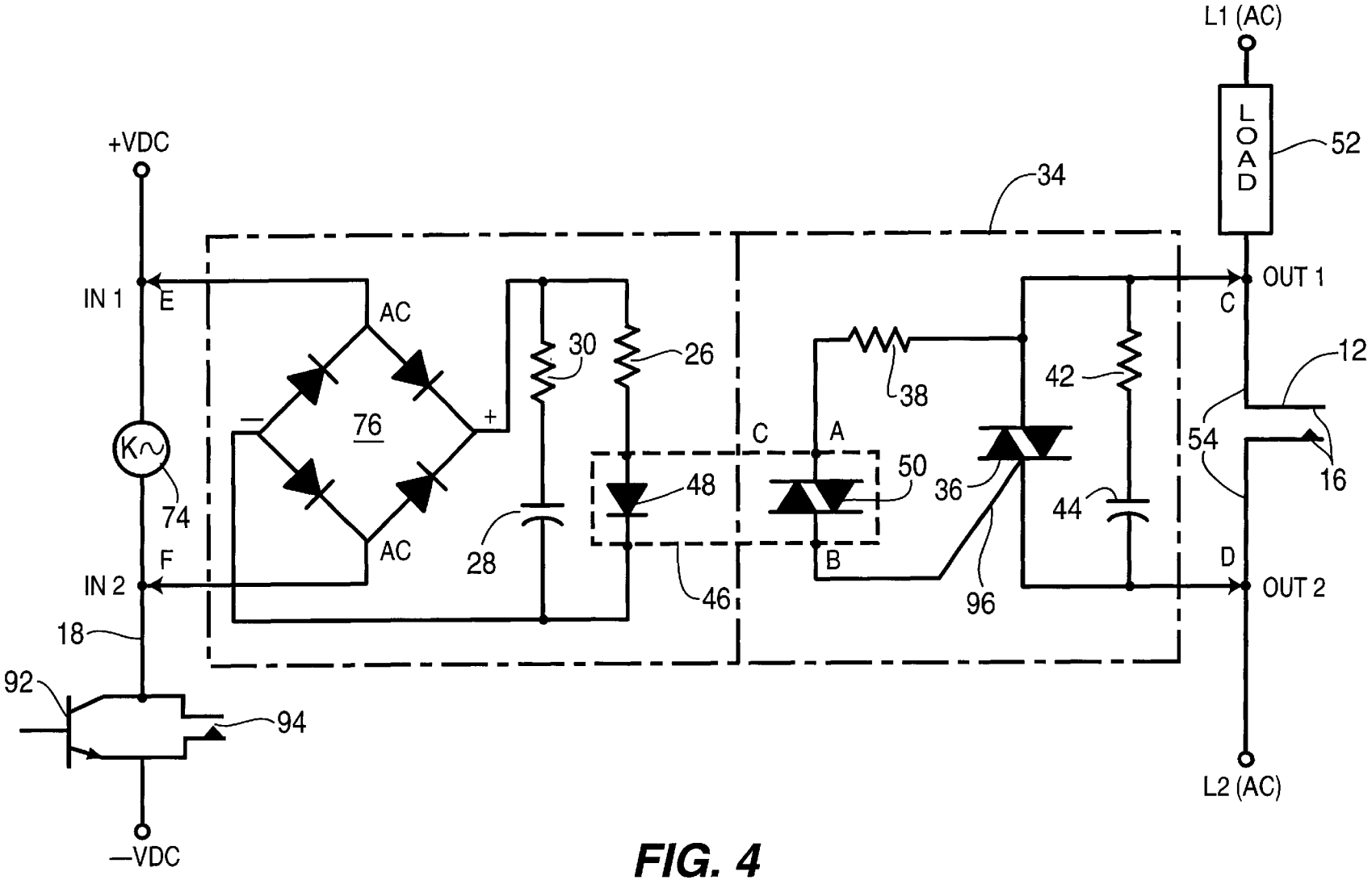
FIG. 4 is an alternative illustration of the embodiment shown in FIG. 1 utilizing a bridge rectifier to allow the first solid state circuit to be operative with an AC relay coil.

FIG. 4 shows a circuit configuration particularly useful with a relay coil 14 which is AC powered. The AC relay coil 74 makes use of a bridge rectifier 76 in the first solid state circuit 22 to initiate corresponding operation of the electromagnetic coupling means 46 in a similar manner however when used with an AC powered coil 74.

Figure 5:
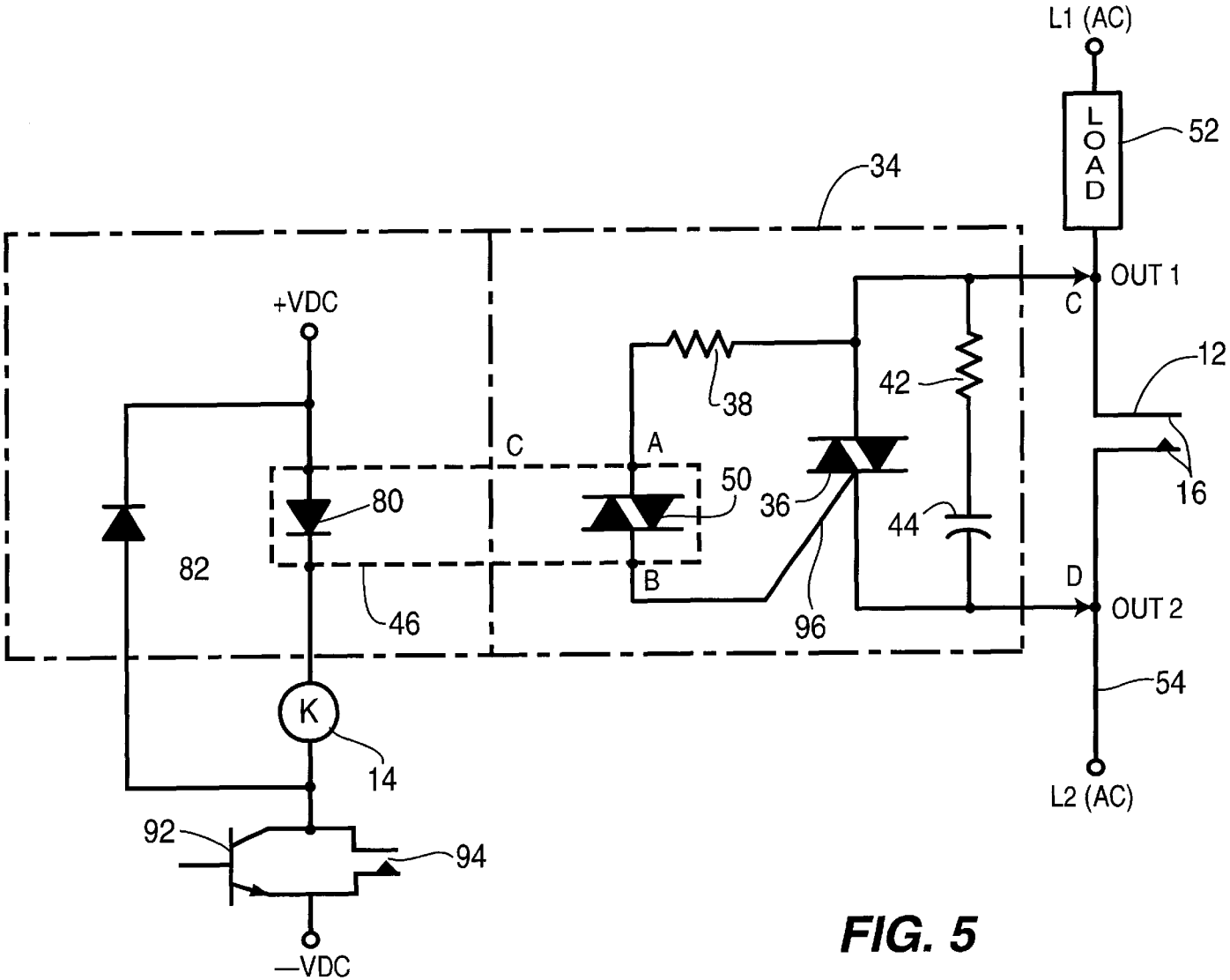
FIG. 5 is an alternative embodiment of the configuration shown in FIG. 1 which utilizes a delay circuit that uses the accumulated energy in the magnetic circuit of the relay coil to power the LED of the optocoupler.

FIG. 5 shows an alternative configuration for the first solid state circuit 22 wherein the light emitting diode 80 is positioned in series with respect to the DC relay coil 14. A parallel diode 82 is positioned in parallel with respect to the series connection between the DC coil 14 and the light emitting diode 80. This is an alternative manner of selectively initiating operation of the electromagnetic coupling device 46.

Figure 6:
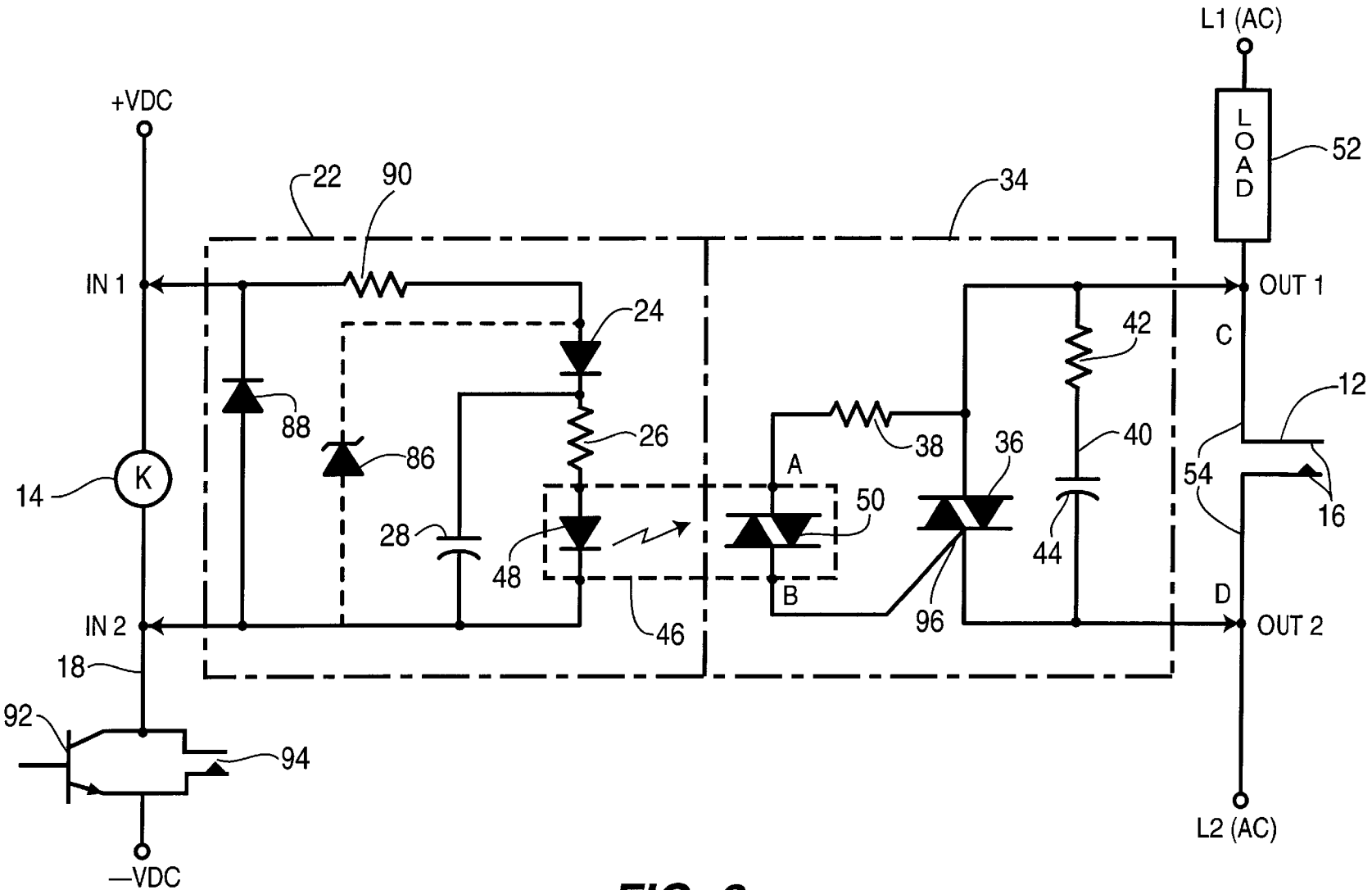
FIG. 6 is an alternative embodiment of the configuration shown in FIG. 1 with the inclusion of a zener diode to allow use of the DC coil with a wide range of different voltages.

In FIG. 6 the use of a zener diode 86 is shown along with a second diode 88 and a supplementary resistor 90. This zener diode configuration allows the use of the DC coil with a wide range of different voltages.

In operation the circuitry as shown in FIG. 1 is initiated upon the closing of either the mechanical switch contacts 94 or the solid state switch 92. This switch closing simultaneously applies DC voltage to the relay coil and to the circuit. The application of this power immediately causes the much faster acting arc suppression circuit 20 including first solid state circuit 22 and second solid state circuit 34 as well as electromagnetic coupling means 46 to activate which thereby shunts across the relay contacts 16 prior to closing. The solid state shunting circuit operates much more quickly than the mechanically controlled closing of the contacts.

When activated the DC voltage source will activate relay coil 14 while at the same time causing current flow through the first diode means 24, the current limiting resistor 26 and the light emitting diode 48 of the optocoupler 46. Also capacitor 28 will immediately charge to the full DC voltage thereof minus the voltage drop across the first diode means 24. The voltage drop across the first diode means 24 is normally approximately 0.5 volts. In this manner the primary capacitor 28 will remain charged and current will continue to flow through the LED 48 of the optocoupler 46 as long as either switch 92 or 94 remains closed.

The current flowing through the light emitting diode 48 of the optocoupler 46 will cause the optocoupler output or optotriac 50 to conduct which will initiate AC current flow through the second solid state circuit 34 and through the AC powering circuit 54 for powering of load 52. This powering will be achieved by the initiation of current to flow through the normal operation of the optocoupler causing the optocoupler output triac driver 50 to conduct which will in turn cause AC current flow through the load 52 as well as through the switch firing resistor 38 as well as through the optocoupler triac driver and the gate 96 of the main triac. This action causes the main triac 36 to go into the conducting state and thereby energize load 52. This entire sequence of events occurs in only a few microseconds whereas the relay contacts 16 require several milliseconds to close. As such, the main triac 36 will begin conducting significantly prior to the actual physical closing of the relay contacts 16. Typically the delay is five to fifty milliseconds later.

Since the triac 36 is electrically in parallel with respect to the relay contacts 16, the AC load current flows through the output triac during the five to fifty milliseconds that it takes for the relay contacts 16 to actually close. During conduction the voltage drop across the triac 36 is typically one or two volts and must remain at that level in order to maintain the triac in the conducting mode. Because of this low voltage drop there is very little, if any, arcing across the relay contacts 16 while the contacts move to full closure. Also since the voltage drop across the closed contacts 16 drops to only a fraction of a volt, the voltage across the triac 36 is forced below the threshold required for conduction and, as such, the triac ceases to conduct. Thereafter the relay contacts begin carrying the entire AC load current even though technically the triac is still capable of being powered through the optically activated solid state switch or optotriac 50.

It is important to note that if any bouncing occurs during the mechanical closing of the relay contacts 16 that the output triac 36 will instantaneously re-fire in a manner of microseconds in order to quench any arcing which may occur during the bounce. As soon as the relay contacts again close, the triac will again be moved to the off position due to the significantly lower voltage drop across the relay contacts 16 as compared to across the triac 36. Since the triac is only conducting for a very short period of five to fifty milliseconds and the relay contacts typically remain closed for a minimum of several seconds, the actual time duty cycle for the triac 36 is very small. As such, the normal problem of requiring extensive heat dissipation when carrying such large AC power loads is not a problem. For this reason no heat sinking is required primarily due to the fact that the triac is on for such a short period of time.

Upon opening of the mechanical switch 94 or solid state switch 92 the relay coil 14 will be de-powered due to the interruption in DC current supply thereto. Again the responsiveness of the arc suppression circuitry 20 will be much faster than the coordinated operation of the opening of the relay contacts 16 responsive to de-powering of coil 14. Normally the relay contacts require five to fifty milliseconds to open and, as such, the triac 36 must be armed and ready to fire as soon as the contacts merely start to open such that any quenching during the initial microseconds of opening can be quenched.

The first solid state circuit 22 will be operative to control this arcing due to the fact that the primary capacitor 28 is fully charged at the moment of de-powering of the relay coil 14. As such, when the first sold state circuit 22 is deactivated the primary capacitor 28 will discharge through the current limiting resistor 26 and then through the light emitting diode 48. This subsequent operation of the light emitting diode 48 will only occur for the short period of time while the primary capacitor 28 is discharging. However, this time is sufficient enough to render the main triac 36 operative during the initial moments of separation of the relay contacts 16 from one another in order to eliminate arcing as they start to move apart.

With proper sizing of the current limiting resistor 26 and the capacitor 28 the second solid state circuit 34 with the main triac 36 will be active long enough to allow the relay contacts to open to a position far enough from one another that arcing is no longer a problem. The triac will thus be ready to fire as soon as the relay contacts 16 begin to open. With this configuration it should be noted that the first diode means 24 in the first solid state circuit prevents the primary capacitor 28 from discharging through the relay coil 14.

As soon as the relay contacts 16 start opening the voltage across the triac 36 will quickly rise toward the line voltage. As soon as this voltage is high enough to produce the necessary gate current the triac 36 will begin conducting again and the current of the AC powering circuit 54 will be directed through the triac 36. Since the voltage drop across the triac is only one to two volts, the relay contacts 16 will open without significant arcing. The output triac 36 will stay on only until the primary capacitor 28 is discharged below the minimum operating voltage of the arc suppression circuit 20. By that time the relay contacts 16 will have separated to such an extent that arcing is no longer possible and the triad 36 will switch to the non-conducting state after the first zero crossing thereby stopping the flow of the AC current. Since the primary capacitor 28 will discharge very rapidly the triac 36 is only conducting for a short period of time which is normally fifty to a hundred milliseconds and, as such, there are no requirements for heat dissipation or any heat sink apparatus to be included attached to main triac 36.

The configuration shown in FIG. 5 shows an alternative configuration for the first solid state circuit means 22. This configuration makes use of the delay. circuit which uses the accumulated energy and the magnetic circuit of the relay coil 14. Upon applying power to the coil 14 by way of switch 92 or 94 current will flow also through the light emitting diode 80 of the optocoupler 46 causing the optotriac to be energized. This in turn will cause the main triac 36 to be energized through the switch firing resistor 38. These events will occur in only a matter of microseconds and, as such, the main triac 36 will be energized well before the relay contacts 16 close thereby shunting the load current away from these contacts at the moment of closing to prevent arcing thereover. Once the relay contacts are closed the main triac 36 will cease to conduct because the voltage drop across the relay contacts 16 is lower than the voltage necessary to keep the triac 36 conducting. The relay contacts 16 will continue to carry the full load current and the triac 36 will remain non-conductive for as long as the relay coil 14 remains energized.

When power is removed from the coil by opening of switches 92 and 94 the collapsing magnetic field will produce a voltage with a polarity such that the coil current will continue to flow in the same direction as before power was interrupted and in this manner delay the drop out of the relay contacts 16 for a few milliseconds. Since the current flow will flow from the coil through first diode 24 and light emitting diode 48 and return to the other side of the coil the optical coupler 46 will remain energized thus keeping the main triac 36 in the conducting state as well. As the energy of the coil 14 is dissipated this current will decay almost exponentially toward zero. However, because the current required to maintain the optical coupler energized is less than that required to keep the relay contacts 16 closed the relay contacts will open before the optocoupler 46 turns off and the main triac 36 stops conducting. In this manner the main triac 36 will shunt the load current away from the opening relay contacts 16 and prevent damaging arcing. When the current decays sufficiently to allow the optocoupler 46 to turn off the main triac 36 it will stop conducting at the next zero crossing of the AC line.

There is a natural asymmetry associated with the voltage drop across a triac or thyristor when conducting in opposition directions. This asymmetry can be eliminated by placing the triac or thyristor on the DC side of a diode bridge rectifier 62 as shown in FIG. 2 in such a manner that conduction therethrough is always in the same direction. As such, the advantages of the configuration shown in FIG. 2 under operation are readily apparent.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A relay circuit means for controlling the application of AC power to an load using a relay having arc suppression circuitry, which comprising;

A. a relay means comprising;

(1) relay contacts being movable between an open position preventing AC current flow therebetween and a closed position allowing AC current flow therebetween;

(2) a relay coil means electromagnetically operatively connected to said relay contacts and being operative to urge said relay contacts to the closed position responsive to powering of said relay coil means and being operative to allow movement of said relay contacts to the open position responsive to de-powering of said relay coil means;

B. a relay coil powering circuit means electrically in series with said relay coil means for selectively powering and de-powering thereof;

C. arc suppression circuit means for sensing powering and de-powering of said relay coil means and for suppressing transient electrical arcing across said relay contacts during closing and opening thereof, said arc suppression circuit means comprising:

(1) a first solid state circuit means in electrical communication with said relay coil powering circuit means to be selectively responsive to powering and de-powering of said relay coil means, said first solid state circuit means including a parallel diode means for facilitating suppression of electrical spikes in said relay coil means;

(2) a second solid state circuit means being responsive to said first solid state circuit means to sense activation and de-activation of said first solid state circuit means, said second solid state circuit means being connected electrically in parallel with respect to said relay contacts to prevent arcing therebetween;

(3) an electromagnetic coupling means operative to provide electrical communication between said first solid state circuit means and said second solid state circuit means to selectively cause powering of said second solid state circuit means responsive to electric operation of said first solid state circuit means, said electromagnetic coupling means including a light emitting diode means in series with said relay coil means, said parallel diode means of said first solid state circuit means being positioned electrically in parallel with respect to both said relay coil means and said electromagnetic coupling means to further facilitate suppression of electrical spikes in said relay coil means;

D. an AC load means positioned electrically in series with said relay contacts; and E. an AC powering circuit means electrically in communication with said AC load means for selectively supplying AC power thereto responsive to closing of said relay contacts.

2. A relay circuit means for controlling the application of AC power to an load using a relay having arc suppression circuitry as defined in claim 1 wherein said first solid state circuit means is electrically in parallel with respect to said relay coil means.

3. A relay circuit means for controlling the application of AC power to an load using a relay having arc suppression circuitry as defined in claim 2 wherein said first solid state circuit means includes:

A. a first diode means in series with said electromagnetic coupling means to maintain current flow therethrough in only one direction; and B. a current limiting resistor means in series with said first diode means and positioned between said electromagnetic coupling means and said first diode means to limit current flow therethrough.

4. A relay circuit means for controlling the application of AC power to an load using a relay having arc suppression circuitry as defined in claim 3 wherein said first solid state circuit means further includes a primary capacitor means electrically in parallel with respect to said current limiting resistor means and said light emitting diode means to facilitate operation of said light emitting diode means by discharge of said primary capacitor means immediately after de-powering of said relay coil means.

5. A relay circuit means for controlling the application of AC power to an load using a relay having arc suppression circuitry as defined in claim 4 wherein said first solid state circuit means further includes a discharge resistor means in series with said primary capacitor means.

6. A relay circuit means for controlling the application of AC power to an load using a relay having arc suppression circuitry as defined in claim 1 wherein said first solid state circuit means further includes a second diode means positioned electrically in parallel with respect to said relay coil means and also being electrically in parallel with respect to said first diode means and said light emitting diode means in order to suppress inductive power spiking through said relay coil means.

7. A relay circuit means for controlling the application of AC power to an load using a relay having arc suppression circuitry as defined in claim 1 wherein said second solid state circuit means includes a main solid state switching means positioned electrically in parallel with respect to said relay contacts in order to eliminate transient current arcing across said relay contacts when opening and closing thereof responsive to said main solid state switching means being operative.

8. A relay circuit means for controlling the application of AC power to an load using a relay having arc suppression circuitry as defined in claim 7 wherein said main solid state switching means comprises a main triac.

9. A relay circuit means for controlling the application of AC power to an load using a relay having arc suppression circuitry as defined in claim 7 wherein said electromagnetic coupling means includes an optically activated solid state switching means electrically in communication with respect to said main solid state switching means and operative to activate said main solid state switching means responsive to optical activation of said optically activated solid state switching means.

10. A relay circuit means for controlling the application of AC power to an load using a relay having arc suppression circuitry as defined in claim 9 wherein said optically activated solid state switching means comprises an optotriac.

11. A relay circuit means for controlling the application of AC power to an load using a relay having arc suppression circuitry as defined in claim 9 wherein said second solid state circuit means further includes a switch firing resistor means electrically in series with respect to said optically activated solid state switching means to facilitate control of operation thereof.

12. A relay circuit means for controlling the application of AC power to an load using a relay having arc suppression circuitry as defined in claim 7 wherein said second solid state circuit means includes an RC network means extending parallel with respect to both said main solid state switching means and said relay contacts.

13. A relay circuit means for controlling the application of AC power to an load using a relay having arc suppression circuitry as defined in claim 12 wherein said RC network means includes a network resistor means and a network capacitor means electrically in series with respect to one another.

14. A relay circuit means for controlling the application of AC power to an load using a relay having arc suppression circuitry as defined in claim 1 wherein said first solid state circuit means includes:

A. a first diode means in series with said electromagnetic coupling means to maintain current flow therethrough in only one direction;

B. a current limiting resistor means in series with said first diode means and positioned between said electromagnetic coupling means and said first diode means to limit current flow therethrough;

C. a primary capacitor means electrically in parallel with respect to said current limiting resistor means and said electromagnetic coupling means to facilitate activation of said second solid state circuit means by discharge of said primary capacitor means immediately after de-powering of said relay coil means; and D. a zener diode means positioned electrically in parallel with respect to said current limiting resistor means and said first diode means to allow use of the relay circuit means with a wide variation in voltages.

15. A relay circuit means for controlling the application of AC power to an load using a relay having arc suppression circuitry as defined in claim 14 wherein said first solid state circuit means further includes a supplementary resistor means electrically in series with said first diode means, said current limiting resistor means and said electromagnetic coupling means and positioned between said first diode means and said relay coil means.

16. A relay circuit means for controlling the application of AC power to an load using a relay having arc suppression circuitry, which comprising:

A. a relay means comprising;

(1) relay contacts being movable between an open position preventing AC current flow therebetween and a closed position allowing AC current flow therebetween;

(2) a relay coil means electromagnetically operatively connected to said relay contacts and being operative to urge said relay contacts to the closed position responsive to powering of said relay coil means and being operative to allow movement of said relay contacts to the open position responsive to de-powering of said relay coil means;

B. a relay coil powering circuit means electrically in series with said relay coil means for selectively powering and de-powering thereof;

C. arc suppression circuit means for sensing powering and de-powering of said relay coil means and for suppressing transient electrical arcing across said relay contacts during closing and opening thereof, said arc suppression circuitry means comprising:

(1) a first solid state circuit means in electrical communication with said relay coil powering circuit means to be selectively responsive to powering and de-powering of said relay coil means;

(2) a second solid state circuit means being responsive to said first solid state circuit means to sense activation and de-activation of said first solid state circuit means, said second solid state circuit means being connected electrically in parallel with respect to said relay contacts to prevent arcing therebetween, said second solid state circuit means including:

(a) a main triac and bridge rectifier means positioned electrically in parallel with respect to said relay contacts; and (b) a firing resistor means electrically in series with said main triac-bridge rectifier means;

(3) an electromagnetic coupling means operative to provide electrical communication between said first solid state circuit means and said second solid state circuit means to selectively cause powering of said second solid state circuit means responsive to electric operation of said first solid state circuit means, said main triac being electrically in communication with said electromagnetic coupling means to be activated responsive to activation of said electromagnetic coupling means from said first solid state circuit means, said firing resistor means being electrically in series between said main triac-bridge rectifier means and said electromagnetic coupling means;

D. an AC load means positioned electrically in series with said relay contacts; and E. an AC powering circuit means electrically in communication with said AC load means for selectively supplying AC power thereto responsive to closing of said relay contacts.

17. A relay circuit means for controlling the application of AC power to an load using a relay having arc suppression circuitry, which comprising:

A. a relay means comprising;

(1) relay contacts being movable between an open position preventing AC current flow therebetween and a closed position allowing AC current flow therebetween;

(2) a relay coil means comprising an AC relay coil means which is electromagnetically operatively connected to said relay contacts and being operative to urge said relay contacts to the closed position responsive to powering of said relay coil means and being operative to allow movement of said relay contacts to the open position responsive to de-powering of said relay coil means;

B. a relay coil powering circuit means electrically in series with said relay coil means for selectively powering and de-powering thereof;

C. arc suppression circuit means for sensing powering and de-powering of said relay coil means and for suppressing transient electrical arcing across said relay contacts during closing and opening thereof, said arc suppression circuitry means comprising:

(1) a first solid state circuit means in electrical communication with said relay coil powering circuit means to be selectively responsive to powering and de-powering of said relay coil means, said first solid state circuit means including a bridge rectifier means to rapidly initiate activation of said first solid state circuit means responsive to the application of AC power to said AC coil means;

(2) a second solid state circuit means being responsive to said first solid state circuit means to sense activation and de-activation of said first solid state circuit means, said second solid state circuit means being connected electrically in parallel with respect to said relay contacts to prevent arcing therebetween;

(3) an electromagnetic coupling means operative to provide electrical communication between said first solid state circuit means and said second solid state circuit means to selectively cause powering of said second solid state circuit means responsive to electric operation of said first solid state circuit means;

D. an AC load means positioned electrically in series with said relay contacts; and E. an AC powering circuit means electrically in communication with said AC load means for selectively supplying AC power thereto responsive to closing of said relay contacts.

* * * * *